US011505391B2

(12) United States Patent
Hashimoto et al.

(10) Patent No.: US 11,505,391 B2
(45) Date of Patent: Nov. 22, 2022

(54) CUSHIONING MEMBER, METHOD FOR MANUFACTURING CUSHIONING MEMBER, AND PACKING BODY

(71) Applicant: KONICA MINOLTA, INC., Tokyo (JP)

(72) Inventors: Takeshi Hashimoto, Okazaki (JP); Narutaka Yoshida, Toyokawa (JP); Hiromi Mizuguchi, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/210,595

(22) Filed: Mar. 24, 2021

(65) Prior Publication Data

US 2021/0371184 A1 Dec. 2, 2021

(30) Foreign Application Priority Data

May 27, 2020 (JP) ..... JP2020-092081

(51) Int. Cl.
*B65D 81/05* (2006.01)
*B65D 81/107* (2006.01)

(52) U.S. Cl.
CPC ..... *B65D 81/052* (2013.01); *B65D 81/107* (2013.01); *B65D 2581/053* (2013.01)

(58) Field of Classification Search
CPC ..... B65D 81/052; B65D 81/107; B65D 2581/053; B65D 81/053; B65D 81/055; B65D 81/054; B65D 81/056; B65D 81/05
USPC ..... 206/522, 521, 586
See application file for complete search history.

(56) References Cited

U.S. PATENT DOCUMENTS

2018/0237201 A1* 8/2018 Hashimoto ..... B32B 27/32

FOREIGN PATENT DOCUMENTS

JP 07149372 * 6/1995 ..... B65D 81/054
JP 2003292051 A 10/2003

* cited by examiner

*Primary Examiner* — Steven A. Reynolds
(74) *Attorney, Agent, or Firm* — Buchanan Ingersoll & Rooney PC

(57) ABSTRACT

A cushioning member includes a medium-filled cushioning component and a surrounding member. The medium-filled cushioning component includes a first cushioning portion and a second cushioning portion. The surrounding member includes a first tubular portion, a second tubular portion, and a connecting portion that connects an end of the first tubular portion in a direction parallel to a first central axis and an end of the second tubular portion in a direction parallel to a second central axis. The connecting portion is bendable such that a posture of the first tubular portion and the second tubular portion is changed between a parallel posture in which the first central axis is parallel to the second central axis and an intersecting posture in which the first central axis intersects the second central axis.

9 Claims, 17 Drawing Sheets

CUSHIONING MEMBER, METHOD FOR MANUFACTURING CUSHIONING MEMBER, AND PACKING BODY

The entire disclosure of Japanese Patent Application No. 2020-092081, filed on May 27, 2020, is incorporated herein by reference in its entirety.

BACKGROUND

Technological Field

The present invention relates to a cushioning member, a method for manufacturing the cushioning member, and a packing body.

Description of the Related Art

A cushioning member used in packing of an object to be packed (hereinafter, referred to as "object") has been conventionally known. For example, Japanese Laid-Open Patent Publication No. 2003-292051 discloses a cushion member for packing that protects a product, by being applied to a corner portion where adjacent two or three surfaces of the product housed in an outer box intersect with each other. The cushion member for packing includes a cushion member main body made of corrugated cardboard, having an L-shaped or U-shaped cross section, and having a deformed tubular shape corresponding to the corner portion, and a cushion body inserted into a space in the cushion member main body.

SUMMARY

The cushion member for packing described in Japanese Laid-Open Patent Publication No. 2003-292051 has arrangement constraints because the cushion member for packing is arranged at a corner portion of an object.

An object of the present invention is to provide a cushioning member that can ease arrangement constraints, a method for manufacturing the cushioning member, and a packing body including the cushioning member.

To achieve at least one of the abovementioned objects, according to an aspect of the present invention, a cushioning member reflecting one aspect of the present invention is arranged between an object and an outer box that packs the object, the cushioning member comprising: a medium-filled cushioning component including a resin sheet welded so as to form a bag and a medium filled into the resin sheet; and a surrounding member having a rigidity higher than a rigidity of the medium-filled cushioning component and surrounding the medium-filled cushioning component. The medium-filled cushioning component includes: a first cushioning portion that has a bag shape and has the medium filled therein; and a second cushioning portion that has a bag shape and has the medium filled therein. The surrounding member includes: a first tubular portion that surrounds the first cushioning portion; a second tubular portion that surrounds the second cushioning portion; and a connecting portion that connects an end of the first tubular portion in a direction parallel to a first central axis, which is a central axis of the first tubular portion, and an end of the second tubular portion in a direction parallel to a second central axis, which is a central axis of the second tubular portion. The connecting portion is bendable such that a posture of the first tubular portion and the second tubular portion is changed between a parallel posture in which the first central axis is parallel to the second central axis and an intersecting posture in which the first central axis intersects the second central axis.

To achieve at least one of the abovementioned objects, according to an aspect of the present invention, a method for manufacturing the cushioning member reflecting one aspect of the present invention comprises: a placing step of placing the medium-filled cushioning component on a surrounding member formation material, the surrounding member formation material being formed to be plate-shaped and bendable and being capable of forming the surrounding member, the surrounding member formation material including a first tubular portion formation part that forms the first tubular portion, a second tubular portion formation part that forms the second tubular portion, and the connecting portion; a first tubular portion forming step of forming the first tubular portion around the first cushioning portion by bending the first tubular portion formation part so as to surround the first cushioning portion of the medium-filled cushioning component; and a second tubular portion forming step of forming the second tubular portion around the second cushioning portion by bending the second tubular portion formation part so as to surround the second cushioning portion of the medium-filled cushioning component.

To achieve at least one of the abovementioned objects, according to an aspect of the present invention, a method for manufacturing the cushioning member reflecting one aspect of the present invention comprises: a first placing step of placing the first bag-shaped cushioning element on a surrounding member formation material, the surrounding member formation material being formed to be plate-shaped and bendable and being capable of forming the surrounding member, the surrounding member formation material including a first tubular portion formation part that forms the first tubular portion, a second tubular portion formation part that forms the second tubular portion, the connecting portion, a first partition wall formation part that forms the first partition wall, and a second partition wall formation part that forms the second partition wall; a first partition wall forming step of forming the first partition wall on the first cushioning portion of the first bag-shaped cushioning element by bending the first partition wall formation part; a second partition wall forming step of forming the second partition wall on the second cushioning portion of the first bag-shaped cushioning element by bending the second partition wall formation part; a second placing step of placing the second bag-shaped cushioning element on the first partition wall and the second partition wall; a first tubular portion forming step of forming the first tubular portion around the first cushioning portion of the first bag-shaped cushioning element and the first cushioning portion of the second bag-shaped cushioning element by bending the first tubular portion formation part so as to surround the first cushioning portion of the first bag-shaped cushioning element and the first cushioning portion of the second bag-shaped cushioning element together; and a second tubular portion forming step of forming the second tubular portion around the second cushioning portion of the first bag-shaped cushioning element and the second cushioning portion of the second bag-shaped cushioning element by bending the second tubular portion formation part so as to surround the second cushioning portion of the first bag-shaped cushioning element and the second cushioning portion of the second bag-shaped cushioning element together.

To achieve at least one of the abovementioned objects, according to an aspect of the present invention, a packing body reflecting one aspect of the present invention comprises: an object; an outer box that packs the object; and a plurality of cushioning members arranged between the object and the outer box. Each of the plurality of cushioning members is the above-described cushioning member. The plurality of cushioning members include: a first cushioning member arranged between the object and the outer box in the parallel posture; and a second cushioning member arranged between the object and the outer box in the intersecting posture.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
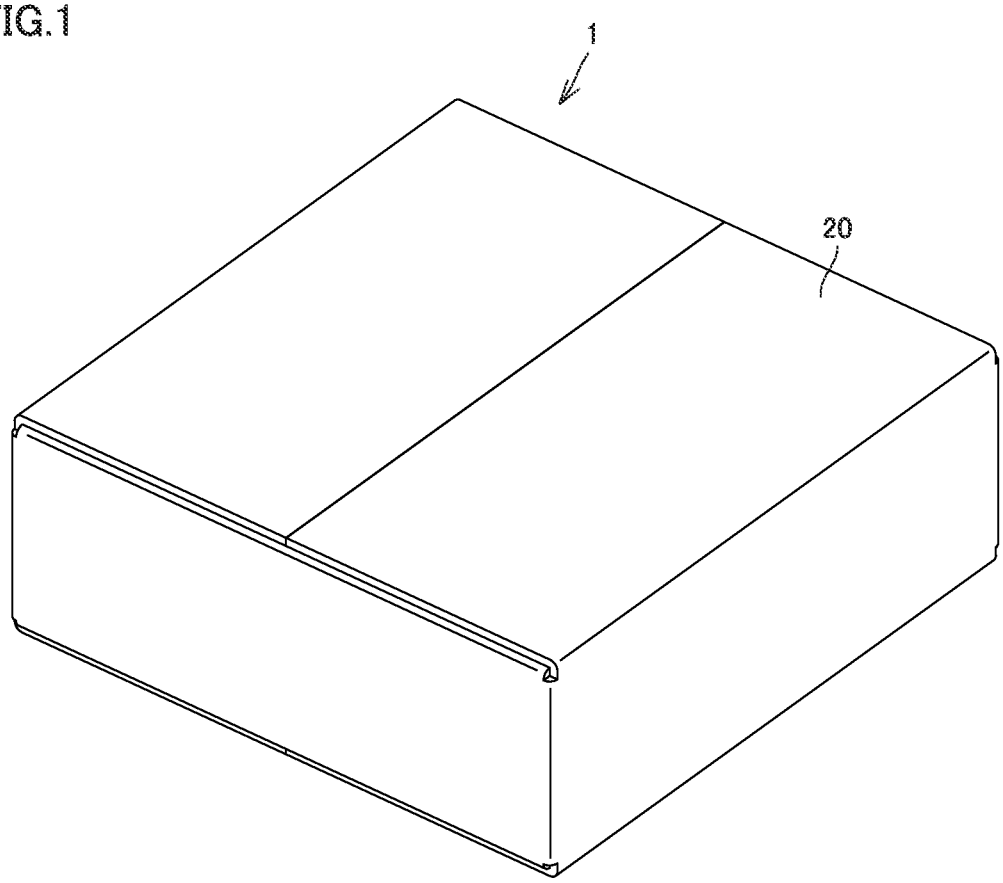
FIG. 1 is a perspective view schematically showing a packing body according to a first embodiment of the present invention.

Hereinafter, one or more embodiments of the present invention will be described with reference to the drawings. However, the scope of the invention is not limited to the disclosed embodiments. In the drawings referenced below, the same or corresponding components are denoted by the same reference numerals.

First Embodiment

Figure 2:
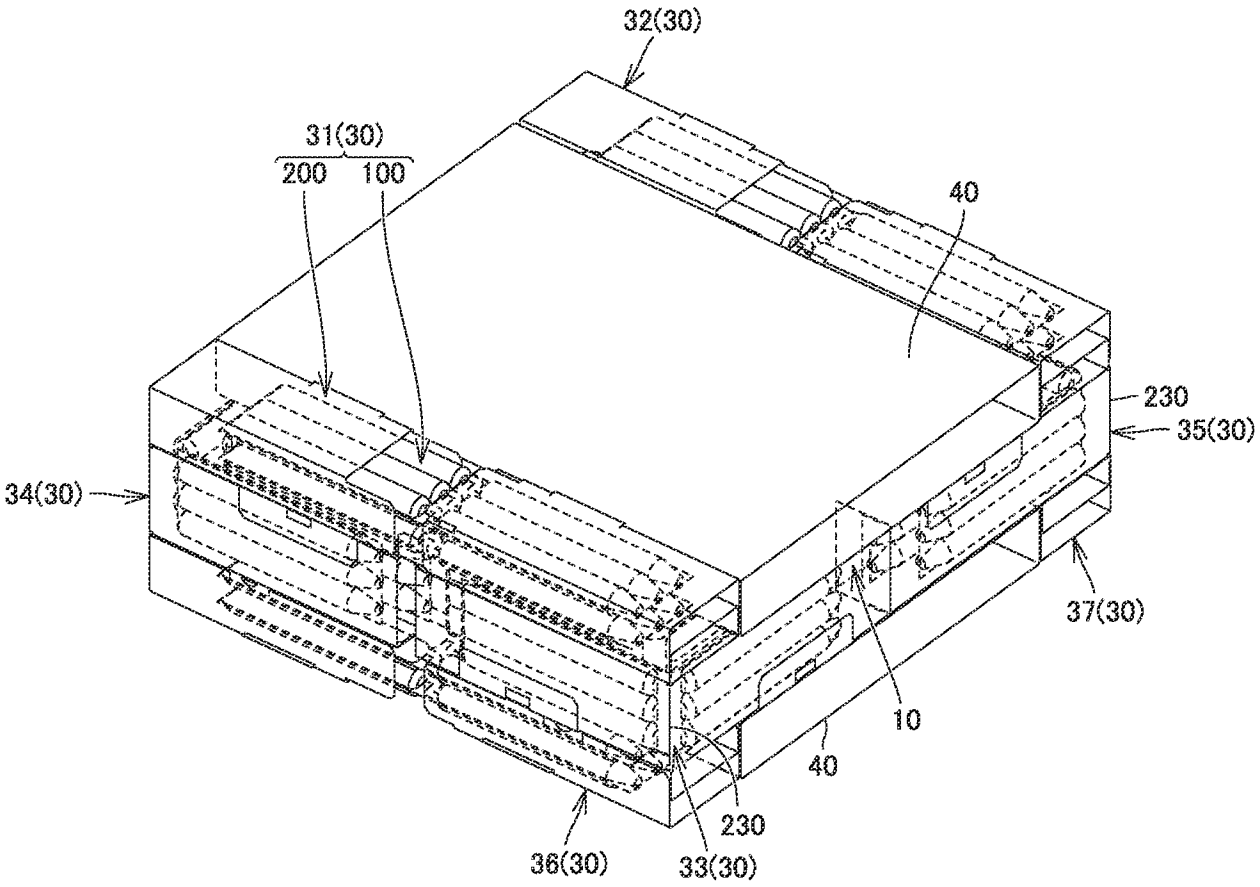
FIG. 2 is a perspective view showing a state in which an outer box is removed from the packing body shown in FIG. 1.

FIG. 1 is a perspective view schematically showing a packing body according to a first embodiment of the present invention. FIG. 1 shows an outer box that houses an object. FIG. 2 shows a state in which the outer box is removed from the packing body shown in FIG. 1. FIG. 2 schematically shows arrangement of cushioning members with respect to the object.

As shown in FIGS. 1 and 2, a packing body 1 includes an object to be packed 10 (hereinafter, referred to as "object 10"), an outer box 20, a plurality of (in the present embodiment, eight) cushioning members 30, and spacers 40. Outer box 20, the plurality of cushioning members 30 and spacers 40 are used in packing of object 10.

Examples of object 10 include an image forming apparatus and the like. Object 10 has a rectangular parallelepiped shape. Object 10 includes an upper surface, side surfaces and a bottom surface. The upper surface, the side surfaces and the bottom surface are formed to be flat.

Outer box 20 is a member that packs object 10. Outer box 20 is shaped so as to cover object 10. Outer box 20 is made of corrugated cardboard and the like.

Spacers 40 are arranged in an upper part and a lower part of object 10. A shape of spacers 40 is changed as appropriate, depending on an outer shape of object 10.

Each cushioning member 30 is arranged between object 10 and outer box 20. Each cushioning member 30 suppresses transmission of external force applied to outer box 20 to object 10. In the present embodiment, the plurality of cushioning members 30 include eight cushioning members 31 to 37. As shown in FIG. 2, two cushioning members 31 and 32 are arranged between the upper surface of object 10 and outer box 20, four cushioning members 33 to 35 are arranged between the side surfaces of object 10 and outer box 20, and two cushioning members 36 and 37 are arranged between the bottom surface of object 10 and outer box 20. FIG. 2 shows only three cushioning members 33 to 35, of the four cushioning members arranged on the side surfaces of object 10. Each of cushioning members 31 to 37 has the same structure.

As shown in FIG. 2, cushioning member 30 includes a medium-filled cushioning component 100 and a surrounding member 200.

Medium-filled cushioning component 100 includes a resin sheet welded to form a bag, and a medium (in the present embodiment, air) filled into the resin sheet. In the present embodiment, medium-filled cushioning component 100 includes a first bag-shaped cushioning element 101 and a second bag-shaped cushioning element 102. Each of first bag-shaped cushioning element 101 and second bag-shaped cushioning element 102 has the same structure. Therefore, first bag-shaped cushioning element 101 will be taken as an example and will be described below.

Figure 3:
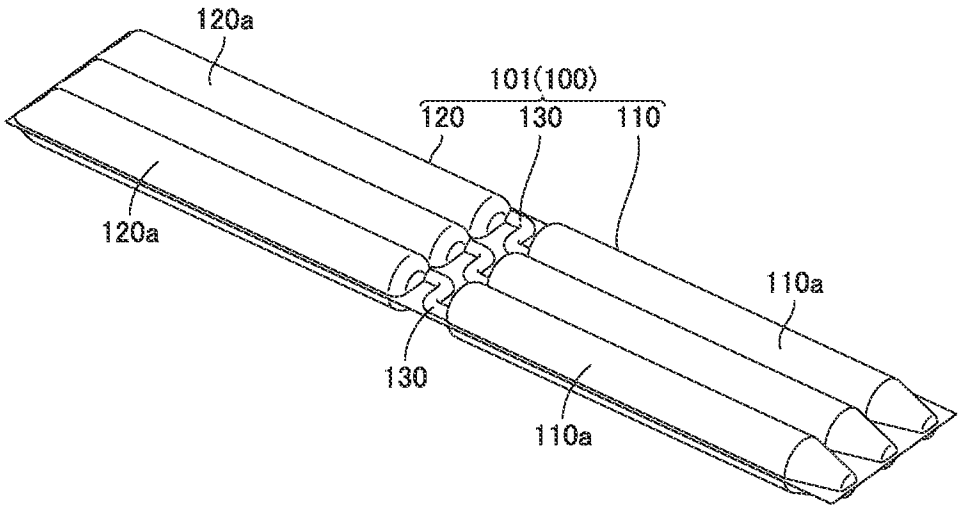
FIG. 3 is a perspective view of a medium-filled cushioning component.

As shown in FIG. 3, first bag-shaped cushioning element 101 includes a first cushioning portion 110, a second cushioning portion 120 and a communicating flow path 130.

First cushioning portion 110 has a bag shape and has the medium filled therein. First cushioning portion 110 is shaped so as to extend long in one direction. First cushioning portion 110 includes a plurality of (in the present embodiment, three) cushioning chambers 110*a*. Each cushioning chamber 110*a* is shaped so as to extend long in one direction. The plurality of cushioning chambers 110*a* are arranged to align in a direction orthogonal to the one direction.

Second cushioning portion 120 has a bag shape and has the medium filled therein. Second cushioning portion 120 is formed at a position spaced apart from first cushioning portion 110 in one direction, and is shaped so as to extend long in one direction. Second cushioning portion 120 includes a plurality of (in the present embodiment, three) cushioning chambers 120*a*. Each cushioning chamber 120*a* is shaped so as to extend long in one direction. The plurality of cushioning chambers 120*a* are arranged to align in a direction orthogonal to the one direction.

Communicating flow path 130 allows first cushioning portion 110 and second cushioning portion 120 to communicate with each other. A cross-sectional area of communicating flow path 130 is set to be smaller than a cross-sectional area of first cushioning portion 110 and a cross-sectional area of second cushioning portion 120. Thus, for example, when external force is applied to second cushioning portion 120, a resistance occurs during passage of the medium from second cushioning portion 120 through communicating flow path 130 to first cushioning portion 110, and thus, a part of impact energy caused by the external force is consumed in communicating flow path 130. Therefore, the cushioning function of medium-filled cushioning component 100 against the external force applied to outer box 20 is enhanced. In addition, a breakage or rupture of each of cushioning portions 110 and 120 when the external force is applied to each of cushioning portions 110 and 120 is suppressed.

As shown in FIG. 2, communicating flow path 130 is formed to be bendable. Communicating flow path 130 connects first cushioning portion 110 and second cushioning portion 120 so as to permit second cushioning portion 120 to bend with respect to first cushioning portion 110.

Surrounding member 200 surrounds medium-filled cushioning component 100. Surrounding member 200 has a rigidity higher than a rigidity of medium-filled cushioning component 100. Surrounding member 200 is made of corrugated cardboard, thick paper and the like. A posture of surrounding member 200 can be changed between a below-described parallel posture (posture shown in FIG. 4) and a below-described intersecting posture (posture shown in FIG. 5).

Figure 4:
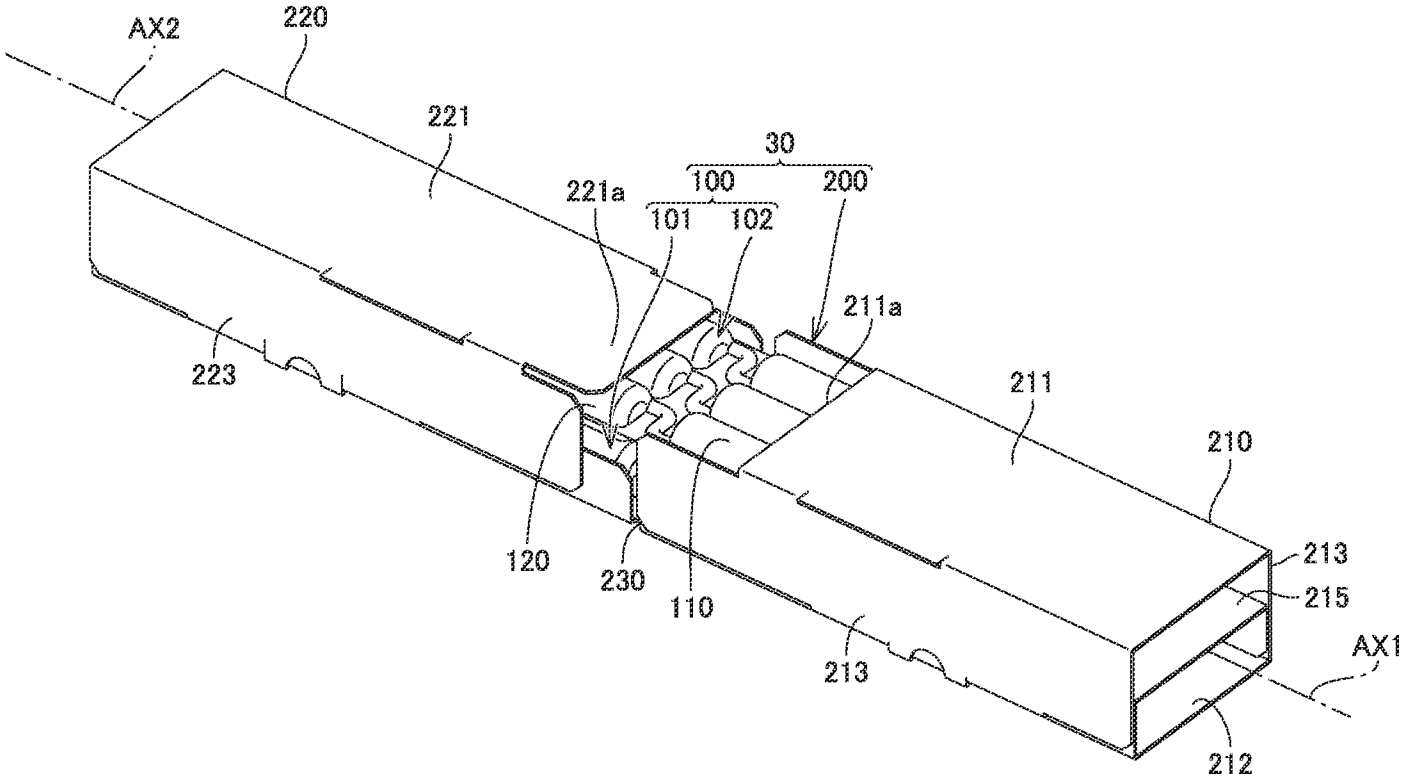
FIG. 4 is a perspective view showing a state in which a cushioning member shown in FIG. 2 is in a parallel posture.
Figure 5:
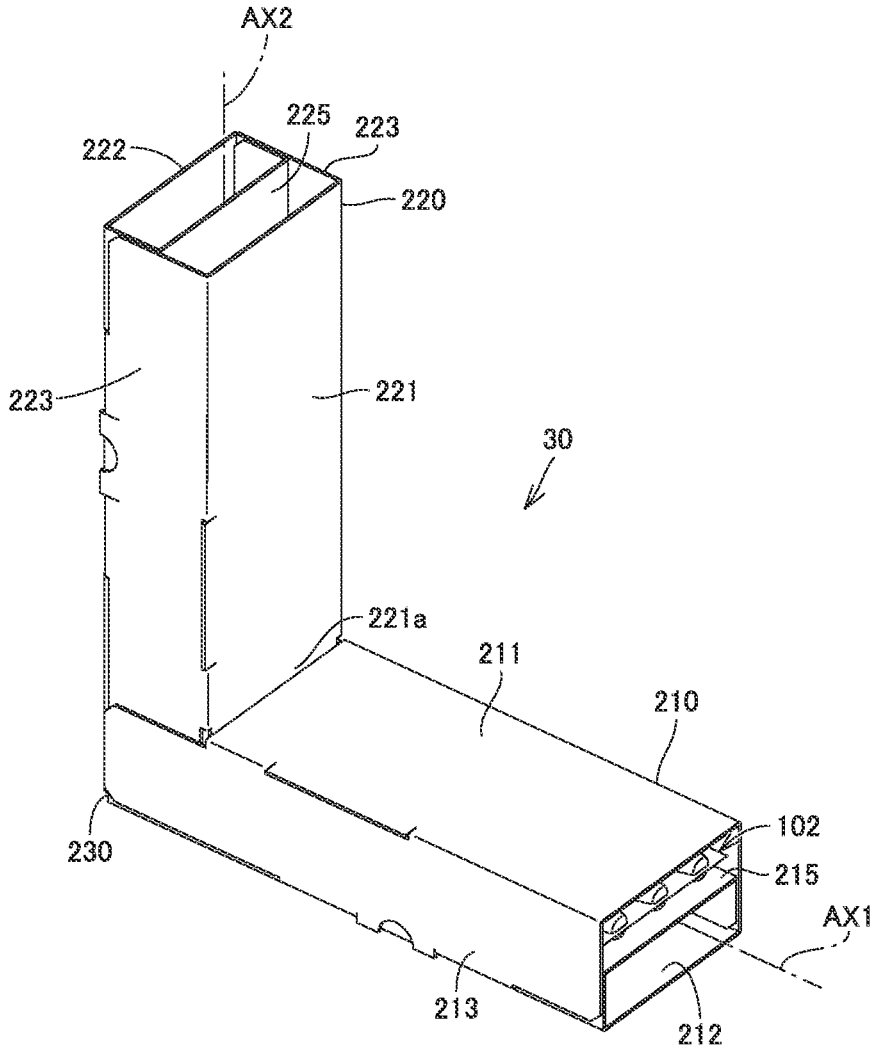
FIG. 5 is a perspective view showing a state in which the cushioning member shown in FIG. 2 is in an intersecting posture.
Figure 6:
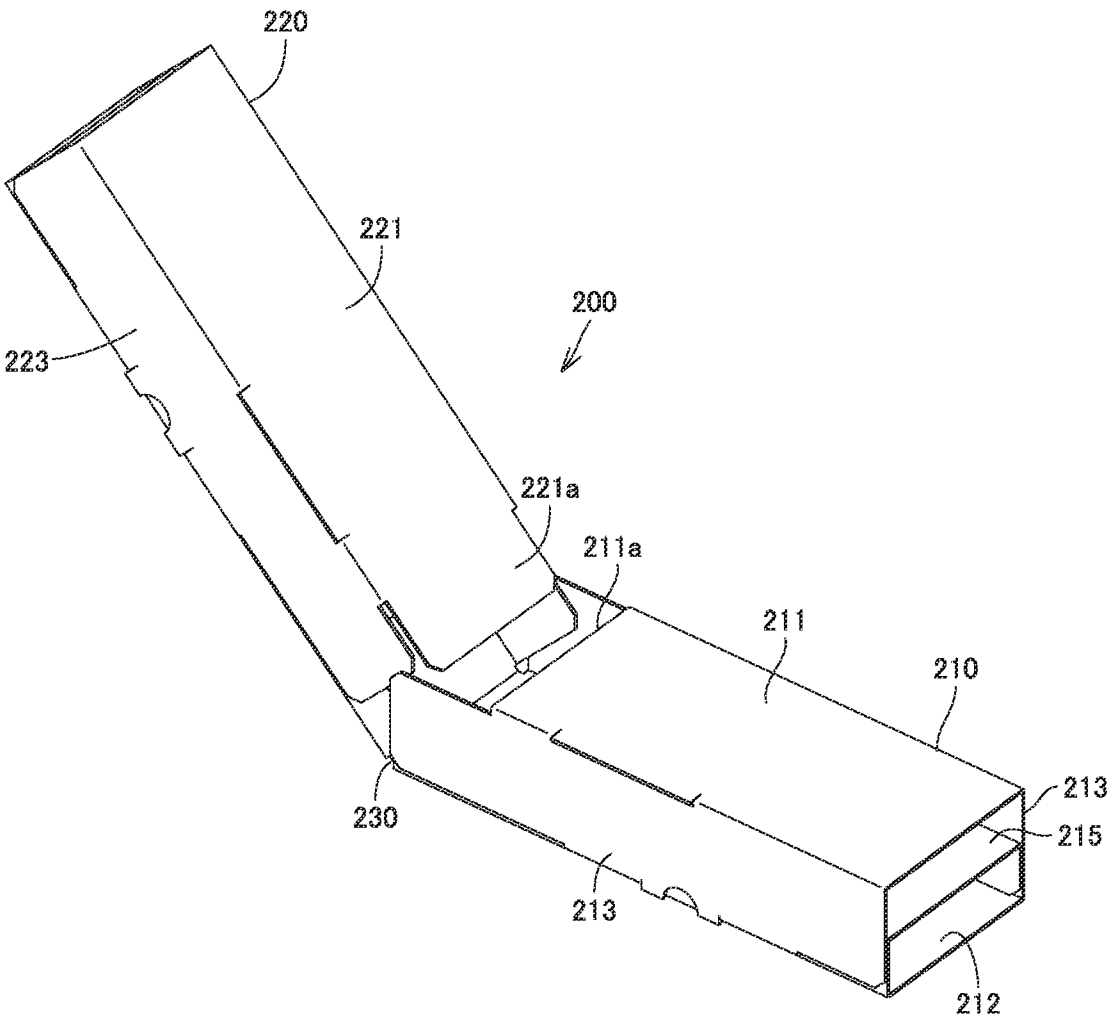
FIG. 6 is a perspective view of a tubular member.
Figure 7:
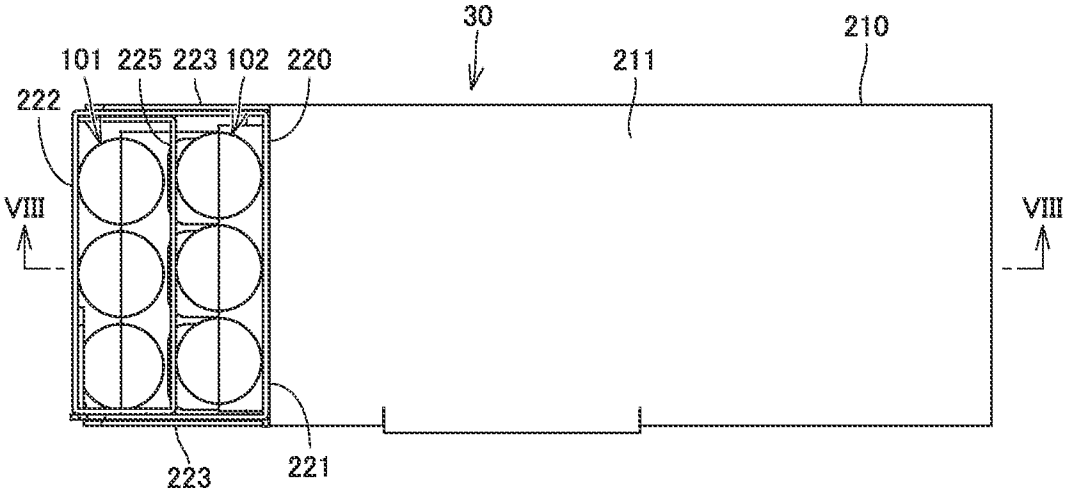
FIG. 7 is a plan view of the cushioning member in the intersecting posture.

As shown in FIGS. 4 to 6, surrounding member 200 includes a first tubular portion 210, a second tubular portion 220 and a connecting portion 230.

First tubular portion 210 surrounds first cushioning portion 110. First tubular portion 210 is formed to have a polygonal tubular shape. In the present embodiment, first tubular portion 210 is formed to have a square tubular shape. First tubular portion 210 includes a first inner plate portion 211, a first outer plate portion 212 and a pair of first side plate portions 213.

First inner plate portion 211 is a portion of first tubular portion 210 that comes closer to second tubular portion 220 when the posture is changed from the parallel posture to the intersecting posture. In the intersecting posture, first inner plate portion 211 intersects a second central axis AX2, which is a central axis of second tubular portion 220.

First outer plate portion 212 is a portion of first tubular portion 210 that faces first inner plate portion 211.

Each of first side plate portions 213 is a portion of first tubular portion 210 that connects first inner plate portion 211 and first outer plate portion 212. First side plate portions 213 face each other.

Second tubular portion 220 surrounds second cushioning portion 120. Second tubular portion 220 is formed to have a polygonal tubular shape. In the present embodiment, second tubular portion 220 is formed to have a square tubular shape. Second tubular portion 220 includes a second inner plate portion 221, a second outer plate portion 222 and second side plate portions 223.

Second inner plate portion 221 is a portion of second tubular portion 220 that comes closer to first inner plate portion 211 when the posture is changed from the parallel posture to the intersecting posture. In the intersecting posture, second inner plate portion 221 intersects first inner plate portion 211.

Second outer plate portion 222 is a portion of second tubular portion 220 that faces second inner plate portion 221.

Each of second side plate portions 223 is a portion of second tubular portion 220 that connects second inner plate portion 221 and second outer plate portion 222. Second side plate portions 223 face each other.

Connecting portion 230 connects an end of first tubular portion 210 in a direction parallel to a first central axis AX1, which is a central axis of first tubular portion 210, and an end of second tubular portion 220 in a direction parallel to second central axis AX2, which is the central axis of second tubular portion 220. Specifically, connecting portion 230 connects an end of first outer plate portion 212 and an end of second outer plate portion 222. As shown in FIGS. 4 to 6, connecting portion 230 is bendable such that the posture of first tubular portion 210 and second tubular portion 220 is changed between the parallel posture and the intersecting posture. In other words, connecting portion 230 connects first tubular portion 210 and second tubular portion 220 so as to permit second tubular portion 220 to bend with respect to first tubular portion 210.

The parallel posture (posture shown in FIG. 4) is a posture in which first central axis AX1 is parallel to second central axis AX2. The intersecting posture (posture shown in FIG. 5) is a posture in which first central axis AX1 intersects second central axis AX2. In the present embodiment, an angle formed by first central axis AX1 and second central axis AX2 in the intersecting posture is 90 degrees.

Surrounding member 200 is bendable at connecting portion 230, and medium-filled cushioning component 100 is bendable at communicating flow path 130. Therefore, as shown in FIG. 2, surrounding member 200 for each of cushioning members 33 to 35 arranged on the side surfaces of object 10 is arranged in the intersecting posture such that first tubular portion 210 faces one side surface of object 10 and second tubular portion 220 faces a side surface of object 10 adjacent to the one side surface. In addition, surrounding member 200 for each of cushioning members 31, 32, 36, and 37 arranged on the upper surface and the lower surface of object 10 is arranged in the parallel posture.

Figure 8:
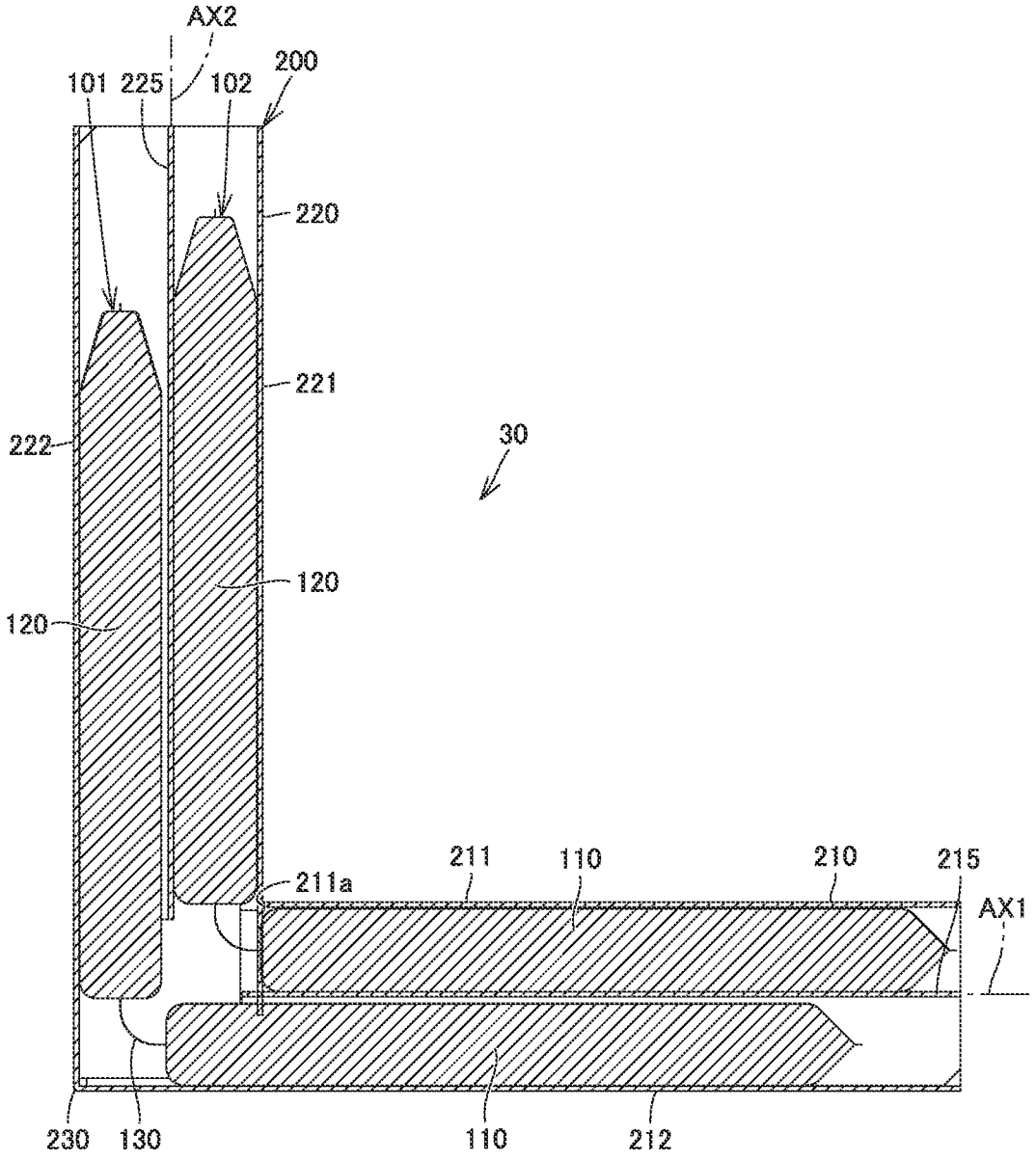
FIG. 8 is a cross-sectional view taken along line VIII-VIII in FIG. 7.
Figure 9:
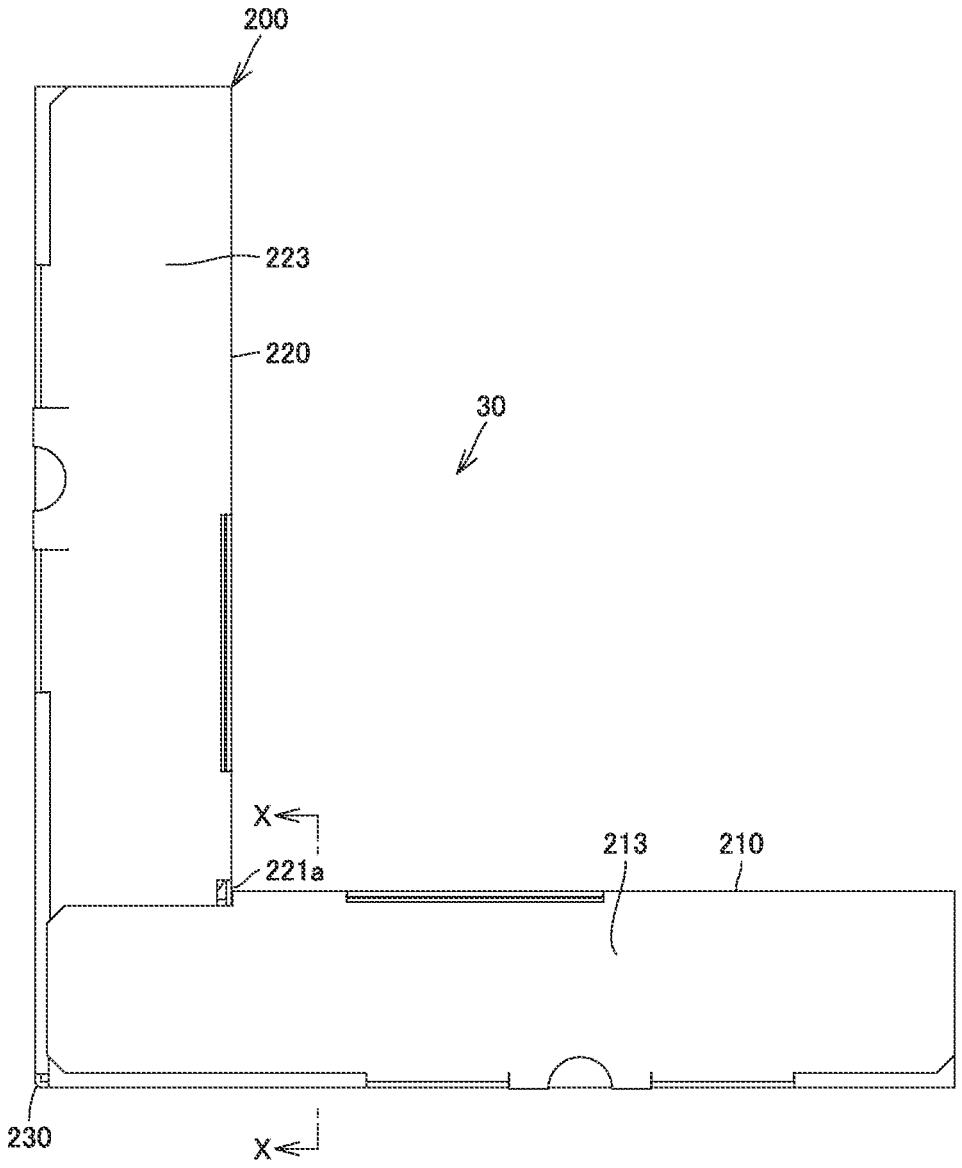
FIG. 9 is a front view of the cushioning member in the intersecting posture.
Figure 10:
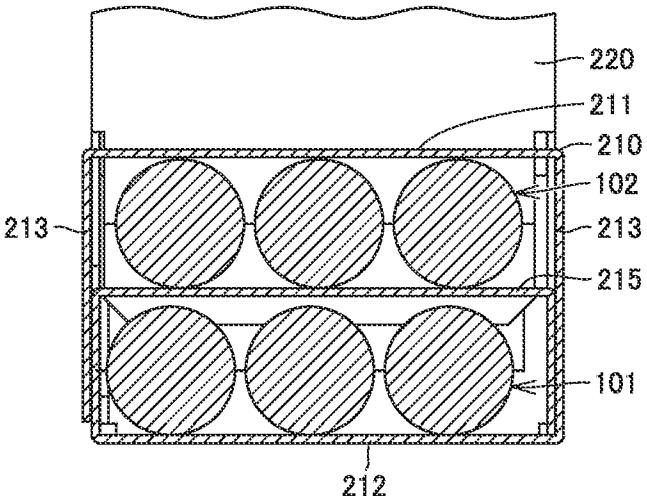
FIG. 10 is a cross-sectional view taken along line X-X in FIG. 9.

As shown in FIG. 8, first tubular portion 210 includes a restricting portion 211*a* that restricts a further movement of second tubular portion 220 in a direction from the parallel posture toward the intersecting posture, by coming into contact with second tubular portion 220 when the posture is the intersecting posture. in the present embodiment, an end of first inner plate portion 211 on the second tubular portion 220 side forms restricting portion 211*a*.

Second inner plate portion 221 includes an abutting portion 221*a* that abuts against restricting portion 211*a* when the posture is the intersecting posture.

A first partition wall 215 is provided in first tubular portion 210. First partition wall 215 partitions first cushioning portion 110 of first bag-shaped cushioning element 101 and first cushioning portion 110 of second bag-shaped cushioning element 102. Together with first tubular portion 210, first partition wall 215 forms a space that houses first cushioning portion 110 of first bag-shaped cushioning element 101, and a space that houses first cushioning portion 110 of second bag-shaped cushioning element 102. First partition wall 215 is parallel to first inner plate portion 211.

A limiting portion (not shown) that limits a relative displacement of medium-filled cushioning component 100 with respect to first tubular portion 210 in a direction parallel to first central axis AX1 may be provided on an inner surface of first tubular portion 210 or first partition wall 215.

A second partition wall 225 is provided in second tubular portion 220. Second partition wall 225 partitions second cushioning portion 120 of first bag-shaped cushioning element 101 and second cushioning portion 120 of second bag-shaped cushioning element 102. Together with second tubular portion 220, second partition wall 225 forms a space that houses second cushioning portion 120 of first bag-shaped cushioning element 101, and a space that houses second cushioning portion 120 of second bag-shaped cushioning element 102. Second partition wall 225 is parallel to second inner plate portion 221.

A limiting portion (not shown) that limits a relative displacement of medium-filled cushioning component 100 with respect to second tubular portion 220 in a direction parallel to second central axis AX2 may be provided on an inner surface of second tubular portion 220 or second partition wall 225.

Figure 11:
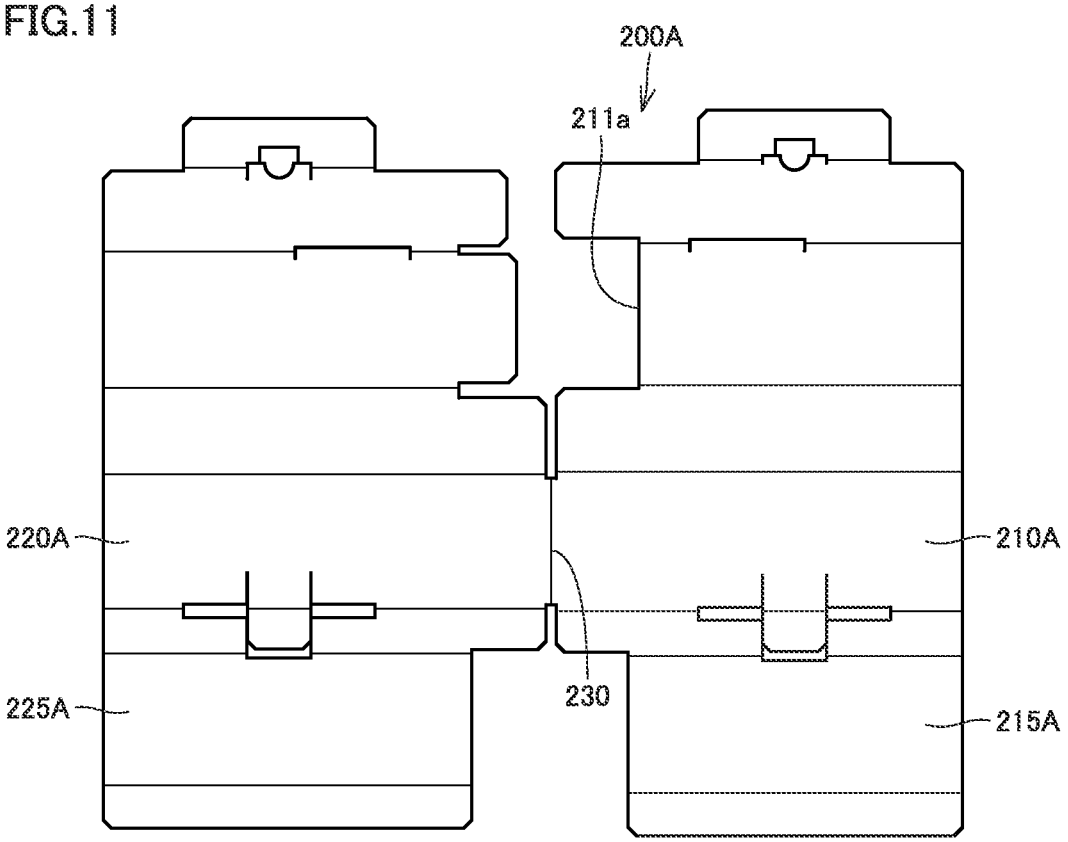
FIG. 11 is a plan view of a surrounding member formation material.

FIG. 11 is a plan view of a surrounding member formation material 200A that forms surrounding member 200. Surrounding member formation material 200A corresponds to a developed view of surrounding member 200. Surrounding member formation material 200A is formed to be plate-shaped and bendable. A portion of surrounding member formation material 200A that is expected to be bent is provided with a bending guide portion that guides bending at this portion.

Surrounding member formation material 200A includes a first tubular portion formation part 210A, a first partition wall formation part 215A, a second tubular portion formation part 220A, a second partition wall formation part 225A, and connecting portion 230.

First tubular portion formation part 210A is a portion that forms first tubular portion 210. First partition wall formation part 215A is a portion that forms first partition wall 215. Second tubular portion formation part 220A is a portion that forms second tubular portion 220. Second partition wall formation part 225A is a portion that forms second partition wall 225.

Next, a method for manufacturing cushioning member 30 will be described. The manufacturing method includes a first placing step, a first partition wall forming step, a second partition wall forming step, a second placing step, a first tubular portion forming step, and a second tubular portion forming step.

Figure 12:
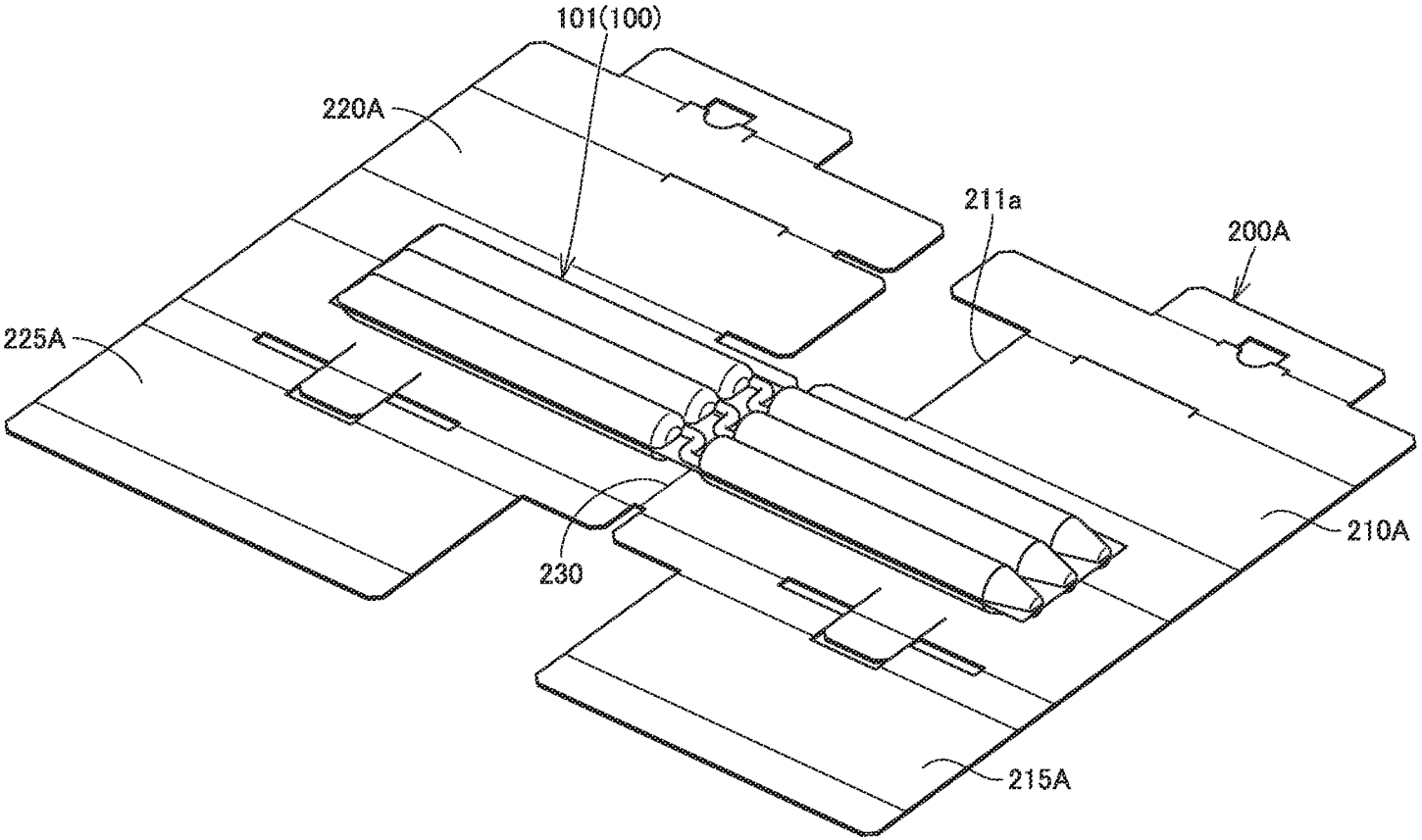
FIG. 12 is a perspective view showing a state in which a first bag-shaped cushioning clement is placed on the surrounding member formation material.

As shown in FIG. 12, in the first placing step, first bag-shaped cushioning element 101 is placed on surrounding member formation material 200A. More specifically, in the first placing step, first bag-shaped cushioning element 101 is placed on surrounding member formation material 200A such that first cushioning portion 110 is located on first outer plate portion 212, second cushioning portion 120 is located on second outer plate portion 222, and communicating flow path 130 is located on connecting portion 230.

In the first partition wall forming step, first partition wall 215 is formed on first cushioning portion 110 of first bag-shaped cushioning element 101 by bending first partition wall formation part 215A.

In the second partition wall forming step, second partition wall 225 is formed on second cushioning portion 120 of first bag-shaped cushioning element 101 by bending second partition wall formation part 225A.

Figure 13:
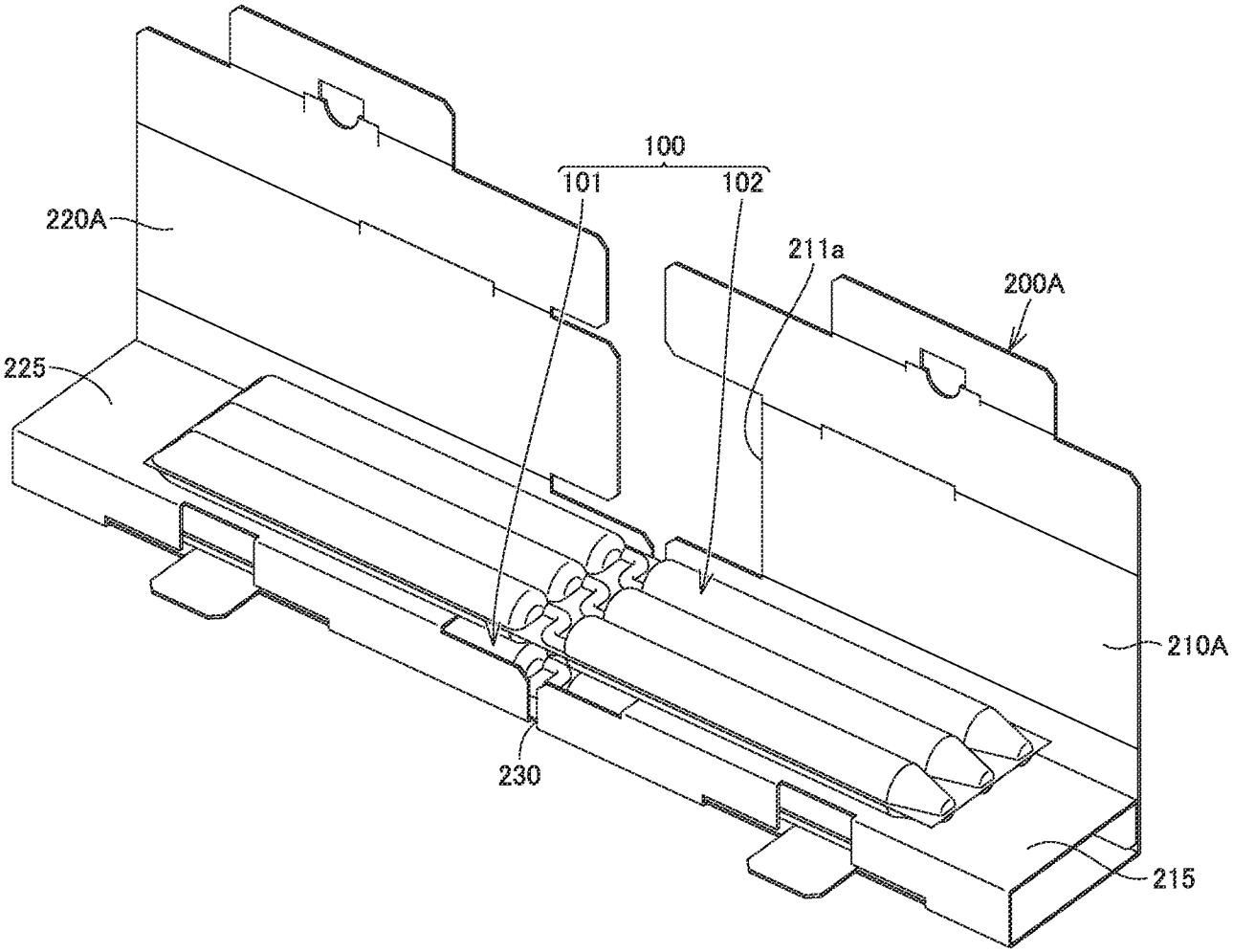
FIG. 13 is a perspective view showing a state in which a second bag-shaped cushioning element is placed on a first partition wall and a second partition wall.
Figure 14:
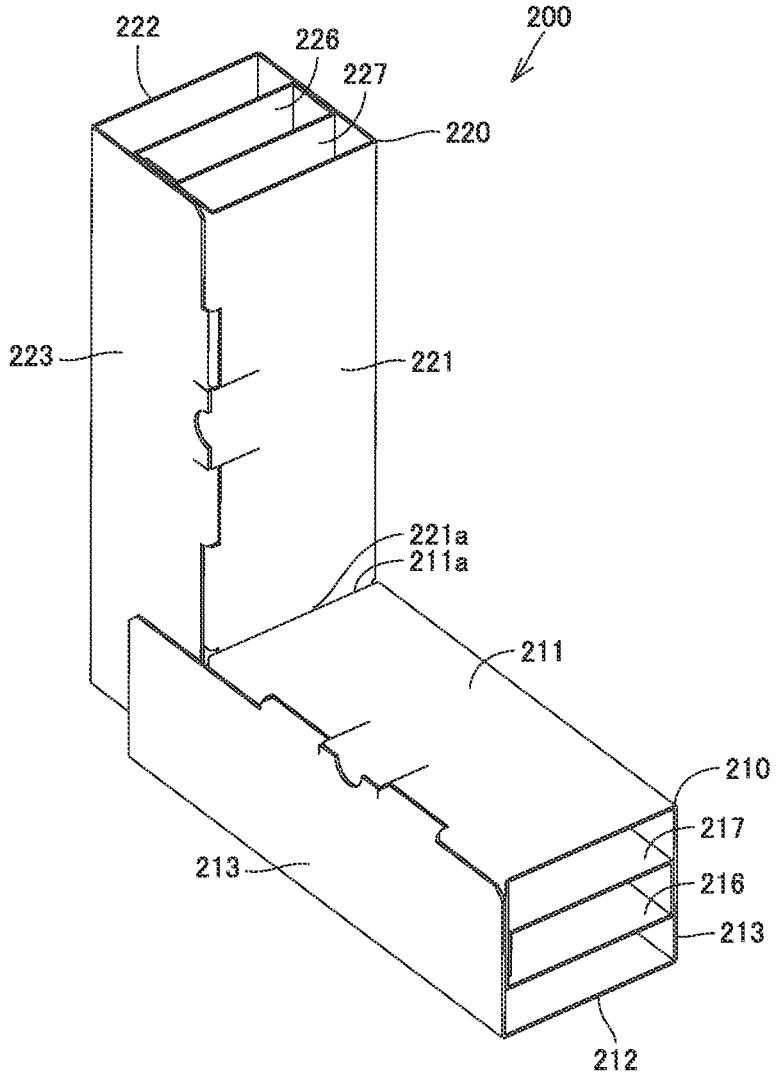
FIG. 14 is a perspective view of a surrounding member for a cushioning member according to a second embodiment of the present invention.
Figure 15:
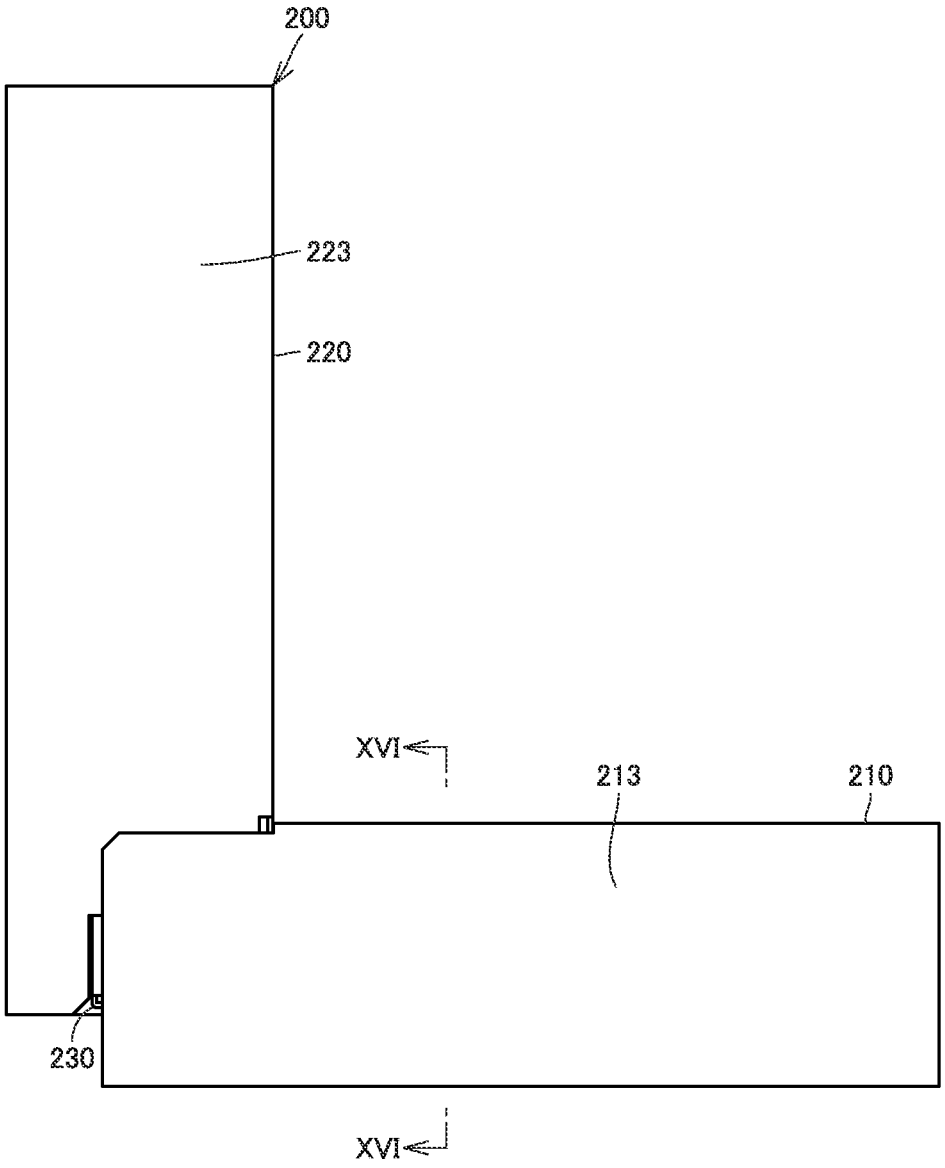
FIG. 15 is a side view of the surrounding member shown in FIG. 14.
Figure 16:
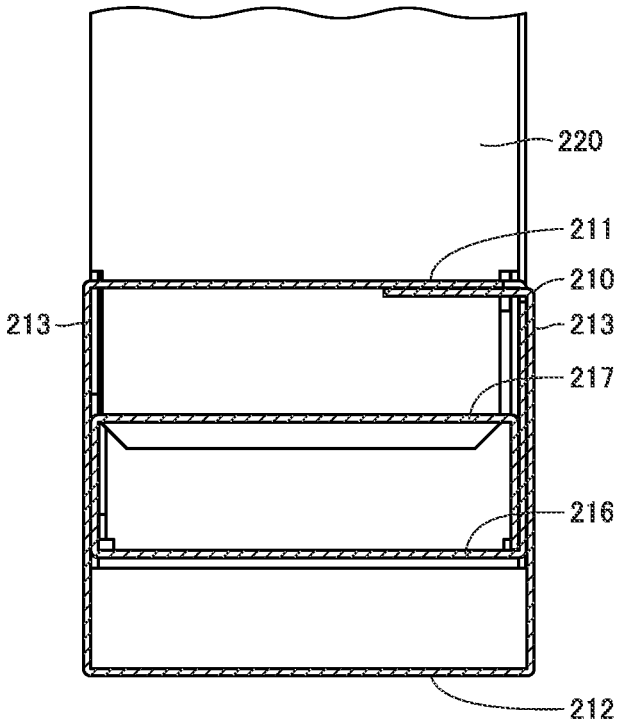
FIG. 16 is a cross-sectional view taken along line XVI-XVI in FIG. 15.
Figure 17:
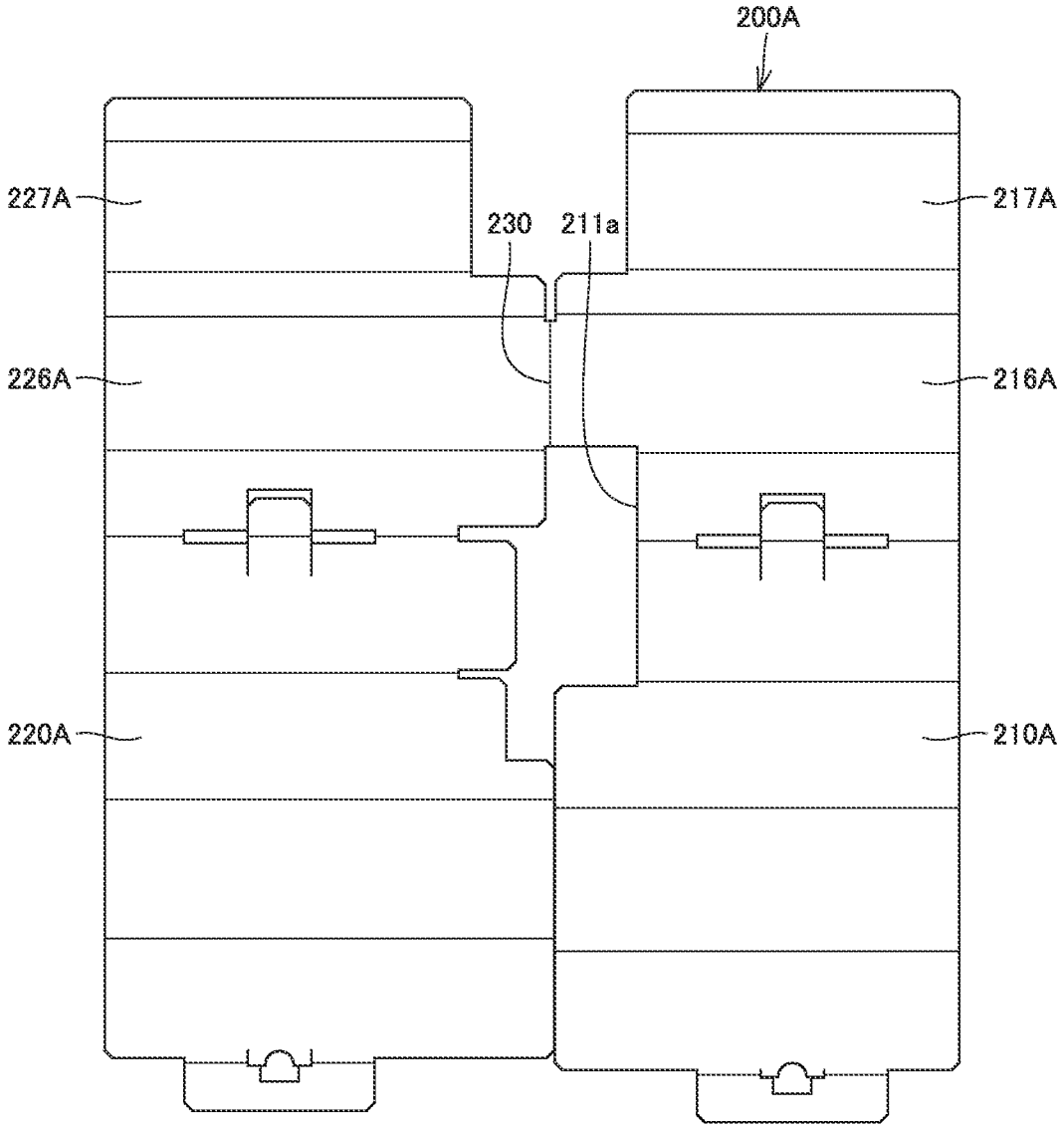
FIG. 17 is a plan view of a surrounding member formation material that forms the surrounding member shown in FIG. 14.

As shown in FIG. 13, in the second placing step, second bag-shaped cushioning element 102 is placed on first partition wall 215 and second partition wall 225. More specifically, second bag-shaped cushioning element 102 is placed on first partition wall 215 and second partition wall 225 such that first cushioning portion 110 is located on first partition wall 215, second cushioning portion 120 is located on second partition wall 225, and communicating flow path 130 is located on connecting portion 230.

In the first tubular portion forming step, first tubular portion 210 is formed around first cushioning portion 110 of first bag-shaped cushioning element 101 and first cushioning portion 110 of second bag-shaped cushioning element 102 by bending first tubular portion formation part 210A so as to surround first cushioning portion 110 of first bag-shaped cushioning element 101 and first cushioning portion 110 of second bag-shaped cushioning element 102 together.

In the second tubular portion forming step, second tubular portion 220 is formed around second cushioning portion 120 of first bag-shaped cushioning element 101 and second cushioning portion 120 of second bag-shaped cushioning element 102 by bending second tubular portion formation part 220A so as to surround second cushioning portion 120 of first bag-shaped cushioning element 101 and second cushioning portion 120 of second bag-shaped cushioning element 102 together.

As described above, in cushioning member 30 according to the present embodiment, connecting portion 230 is bendable such that the posture of first tubular portion 210 and second tubular portion 220 is changed between the parallel posture and the intersecting posture. Therefore, arrangement constraints are eased.

In the above-described embodiment, first partition wall 215 and second partition wall 225 may be omitted. In this case, medium-filled cushioning component 100 may include two bag-shaped cushioning elements 101 and 102, or may include only one bag-shaped cushioning element.

In addition, communicating flow path 130 may be omitted from medium-filled cushioning component 100, such that first cushioning portion 110 and second cushioning portion 120 may be separated from each other.

Second Embodiment

Next, surrounding member 200 for cushioning member 30 according to a second embodiment of the present invention will be described with reference to FIGS. 14 to 17. Medium-filled cushioning component 100 is not shown in FIGS. 14 to 17. In the second embodiment, the differences from the first embodiment will be only described and description of the same structure, function and effect as those of the first embodiment will not be repeated.

In the present embodiment, two first partition walls 216 and 217 are provided in first tubular portion 210, and two second partition walls 226 and 227 are provided in second tubular portion 220. That is, each of first tubular portion 210 and second tubular portion 220 has a three-stage structure.

In the present embodiment, medium-filled cushioning component 100 further includes a third bag-shaped cushioning element (not shown). A structure of the third bag-shaped cushioning element is the same as that of first bag-shaped cushioning element 101.

The second embodiment provides a higher level of the cushioning function than that of the first embodiment.

The above-described exemplary embodiments are understood as specific examples of the following by those skilled in the art.

A cushioning member according to the above-described embodiments is a cushioning member arranged between an object and an outer box that packs the object, the cushioning member including: a medium-filled cushioning component including a resin sheet welded so as to form a bag and a medium filled into the resin sheet; and a surrounding member having a rigidity higher than a rigidity of the medium-filled cushioning component and surrounding the medium-filled cushioning component. The medium-filled cushioning component includes: a first cushioning portion that has a bag shape and has the medium filled therein; and a second cushioning portion that has a bag shape and has the medium filled therein. The surrounding member includes: a first tubular portion that surrounds the first cushioning portion; a second tubular portion that surrounds the second cushioning portion; and a connecting portion that connects an end of the first tubular portion in a direction parallel to a first central axis, which is a central axis of the first tubular portion, and an end of the second tubular portion in a direction parallel to a second central axis, which is a central axis of the second tubular portion. The connecting portion is bendable such that a posture of the first tubular portion and the second tubular portion is changed between a parallel posture in which the first central axis is parallel to the second central axis and an intersecting posture in which the first central axis intersects the second central axis.

In the cushioning member, the connecting portion is bendable such that the posture of the first tubular portion and the second tubular portion is changed between the parallel posture and the intersecting posture. Therefore, arrangement constraints are eased.

Preferably, the first tubular portion includes a restricting portion that restricts a further movement of the second tubular portion in a direction from the parallel posture toward the intersecting posture, by coming into contact with the second tubular portion when the posture is the intersecting posture.

With such a configuration, the intersecting posture of the surrounding member is effectively determined.

Preferably, each of the first tubular portion and the second tubular portion is formed to have a polygonal tubular shape, the first tubular portion includes a first inner plate portion that comes closer to the second tubular portion when the posture is changed from the parallel posture to the intersecting posture, and intersects the second central axis in the intersecting posture, the second tubular portion includes a second inner plate portion that comes closer to the first inner plate portion when the posture is changed from the parallel posture to the intersecting posture, and intersects the first inner plate portion in the intersecting posture, and an end of the first inner plate portion on the second tubular portion side forms the restricting portion.

Preferably, the medium-filled cushioning component includes: a first bag-shaped cushioning element; and a second bag-shaped cushioning element, each of the first bag-shaped cushioning element and the second bag-shaped cushioning element includes the first cushioning portion and the second cushioning portion, the first cushioning portion of the first bag-shaped cushioning element and the first cushioning portion of the second bag-shaped cushioning element are arranged in the first tubular portion in a state of being stacked in a direction orthogonal to the first central axis, and the second cushioning portion of the first bag-shaped cushioning element and the second cushioning portion of the second bag-shaped cushioning element are arranged in the second tubular portion in a state of being stacked in a direction orthogonal to the second central axis.

With such a configuration, the cushioning function is enhanced, as compared with the case in which the medium-filled cushioning component includes one bag-shaped cushioning element.

Preferably, the surrounding member further includes: a first partition wall that is provided in the first tubular portion and partitions the first cushioning portion of the first bag-shaped cushioning element and the first cushioning portion of the second bag-shaped cushioning element; and a second partition wall that is provided in the second tubular portion and partitions the second cushioning portion of the first bag-shaped cushioning element and the second cushioning portion of the second bag-shaped cushioning element.

With such a configuration, a position of each cushioning member in each tubular portion is stabilized.

Preferably, the medium-filled cushioning component includes a communicating flow path that allows the first cushioning portion and the second cushioning portion to communicate with each other, and the communicating flow path is formed to be bendable.

A method for manufacturing the cushioning member according to the above-described embodiments includes: a placing step of placing the medium-filled cushioning component on a surrounding member formation material, the surrounding member formation material being formed to be plate-shaped and bendable and being capable of forming the surrounding member, the surrounding member formation material including a first tubular portion formation part that forms the first tubular portion, a second tubular portion formation part that forms the second tubular portion, and the connecting portion; a first tubular portion forming step of forming the first tubular portion around the first cushioning portion by bending the first tubular portion formation part so as to surround the first cushioning portion of the medium-filled cushioning component; and a second tubular portion forming step of forming the second tubular portion around the second cushioning portion by bending the second tubular portion formation part so as to surround the second cushioning portion of the medium-filled cushioning component.

In the method for manufacturing the cushioning member, the first tubular portion and the second tubular portion are formed around the cushioning portions by bending the first tubular portion formation part and the second tubular portion formation part, respectively. Therefore, a breakage of the medium-filled cushioning component when the medium-filled cushioning component is arranged in each tubular portion is suppressed, as compared with the case in which each tubular portion is formed and thereafter the medium-filled cushioning component is inserted into the tubular portion.

A method for manufacturing the cushioning member according to the above-described embodiments includes: a first placing step of placing the first bag-shaped cushioning element on a surrounding member formation material, the surrounding member formation material being formed to be plate-shaped and bendable and being capable of forming the surrounding member, the surrounding member formation material including a first tubular portion formation part that forms the first tubular portion, a second tubular portion formation part that forms the second tubular portion, the connecting portion, a first partition wall formation part that forms the first partition wall, and a second partition wall formation part that forms the second partition wall; a first partition wall forming step of forming the first partition wall on the first cushioning portion of the first bag-shaped cushioning element by bending the first partition wall formation part; a second partition wall forming step of forming the second partition wall on the second cushioning portion of the first bag-shaped cushioning element by bending the second partition wall formation part; a second placing step of placing the second bag-shaped cushioning element on the first partition wall and the second partition wall; a first tubular portion forming step of forming the first tubular portion around the first cushioning portion of the first bag-shaped cushioning element and the first cushioning portion of the second bag-shaped cushioning element by bending the first tubular portion formation part so as to surround the first cushioning portion of the first bag-shaped cushioning element and the first cushioning portion of the second bag-shaped cushioning element together; and a second tubular portion forming step of forming the second tubular portion around the second cushioning portion of the first bag-shaped cushioning element and the second cushioning portion of the second bag-shaped cushioning element by bending the second tubular portion formation part so as to surround the second cushioning portion of the first bag-shaped cushioning element and the second cushioning portion of the second bag-shaped cushioning element together.

In the method for manufacturing the cushioning member as well, a breakage of the medium-filled cushioning component when the medium-filled cushioning component is arranged in each tubular portion is suppressed.

A packing body according to the above-described embodiments includes: an object; an outer box that packs the object; and a plurality of cushioning members arranged between the object and the outer box. Each of the plurality of cushioning members is the above-described cushioning member. The plurality of cushioning members include: a first cushioning member arranged between the object and the outer box in the parallel posture; and a second cushioning member arranged between the object and the outer box in the intersecting posture.

Although the embodiments of the present invention have been described, it should be understood that the embodiments disclosed herein are illustrative and non-restrictive in every respect. The scope of the present invention is defined by the terms of the claims and is intended to include any modifications within the scope and meaning equivalent to the terms of the claims.

What is claimed is:

1. A cushioning member arranged between an object and an outer box that packs the object, the cushioning member comprising:

a medium-filled cushioning component including a resin sheet welded so as to form a bag and a medium filled into the resin sheet; and a surrounding member having a rigidity higher than a rigidity of the medium-filled cushioning component and surrounding the medium-filled cushioning component, the medium-filled cushioning component including:

a first cushioning portion extending longitudinally in one direction, wherein the first cushioning portion includes a plurality of cushioning chambers arranged to align orthogonally to the one direction, and wherein each cushioning chamber of the plurality of cushioning chambers of the first cushioning portion has a bag shape and has the medium filled therein; and a second cushioning portion formed at a position spaced apart from the first cushioning portion and extending longitudinally in the one direction, wherein the second cushioning portion includes a plurality of cushioning chambers arranged to align orthogonally to the one direction, and wherein each cushioning chamber of the plurality of cushioning chambers of the second cushioning portion has a bag shape and has the medium filled therein the surrounding member including:

a first tubular portion that surrounds the first cushioning portion;

a second tubular portion that surrounds the second cushioning portion; and a connecting portion that connects an end of the first tubular portion in a direction parallel to a first central axis, which is a central axis of the first tubular portion, and an end of the second tubular portion in a direction parallel to a second central axis, which is a central axis of the second tubular portion, wherein the connecting portion is bendable such that a posture of the first tubular portion and the second tubular portion is changed between a parallel posture in which the first central axis is parallel to the second central axis and an intersecting posture in which the first central axis intersects the second central axis.

2. The cushioning member according to claim 1, wherein the first tubular portion includes a restricting portion that restricts a further movement of the second tubular portion in a direction from the parallel posture toward the intersecting posture, by coming into contact with the second tubular portion when the posture is the intersecting posture.

3. The cushioning member according to claim 2, wherein each of the first tubular portion and the second tubular portion is formed to have a polygonal tubular shape, the first tubular portion includes a first inner plate portion that comes closer to the second tubular portion when the posture is changed from the parallel posture to the intersecting posture, and intersects the second central axis in the intersecting posture, the second tubular portion includes a second inner plate portion that comes closer to the first inner plate portion when the posture is changed from the parallel posture to the intersecting posture, and intersects the first inner plate portion in the intersecting posture, and an end of the first inner plate portion on the second tubular portion side forms the restricting portion.

4. The cushioning member according to claim 1, wherein the medium-filled cushioning component includes:

a first bag-shaped cushioning element; and a second bag-shaped cushioning element, each of the first bag-shaped cushioning element and the second bag-shaped cushioning element includes the first cushioning portion and the second cushioning portion, the first cushioning portion of the first bag-shaped cushioning element and the first cushioning portion of the second bag-shaped cushioning element are arranged in the first tubular portion in a state of being stacked in a direction orthogonal to the first central axis, and the second cushioning portion of the first bag-shaped cushioning element and the second cushioning portion of the second bag-shaped cushioning element are arranged in the second tubular portion in a state of being stacked in a direction orthogonal to the second central axis.

5. The cushioning member according to claim 4, wherein the surrounding member further includes:

a first partition wall that is provided in the first tubular portion and partitions the first cushioning portion of the first bag-shaped cushioning element and the first cushioning portion of the second bag-shaped cushioning element; and a second partition wall that is provided in the second tubular portion and partitions the second cushioning portion of the first bag-shaped cushioning element and the second cushioning portion of the second bag-shaped cushioning element.

6. The cushioning member according to claim 1, wherein the medium-filled cushioning component includes a communicating flow path that allows the first cushioning portion and the second cushioning portion to communicate with each other, and the communicating flow path is formed to be bendable.

7. A method for manufacturing the cushioning member as recited in claim 1, the method comprising:

a placing step of placing the medium-filled cushioning component on a surrounding member formation material, the surrounding member formation material being formed to be plate-shaped and bendable and being capable of forming the surrounding member, the surrounding member formation material including a first tubular portion formation part that forms the first tubular portion, a second tubular portion formation part that forms the second tubular portion, and the connecting portion;

a first tubular portion forming step of forming the first tubular portion around the first cushioning portion by bending the first tubular portion formation part so as to surround the first cushioning portion of the medium-filled cushioning component; and a second tubular portion forming step of forming the second tubular portion around the second cushioning portion by bending the second tubular portion formation part so as to surround the second cushioning portion of the medium-filled cushioning component.

8. A method for manufacturing the cushioning member as recited in claim 5, the method comprising:

a first placing step of placing the first bag-shaped cushioning element on a surrounding member formation material, the surrounding member formation material being formed to be plate-shaped and bendable and being capable of forming the surrounding member, the surrounding member formation material including a first tubular portion formation part that forms the first tubular portion, a second tubular portion formation part that forms the second tubular portion, the connecting portion, a first partition wall formation part that forms the first partition wall, and a second partition wall formation part that forms the second partition wall;

a first partition wall forming step of forming the first partition wall on the first cushioning portion of the first bag-shaped cushioning element by bending the first partition wall formation part;

a second partition wall forming step of forming the second partition wall on the second cushioning portion of the first bag-shaped cushioning element by bending the second partition wall formation part;

a second placing step of placing the second bag-shaped cushioning element on the first partition wall and the second partition wall;

a first tubular portion forming step of forming the first tubular portion around the first cushioning portion of the first bag-shaped cushioning element and the first cushioning portion of the second bag-shaped cushioning element by bending the first tubular portion formation part so as to surround the first cushioning portion of the first bag-shaped cushioning element and the first cushioning portion of the second bag-shaped cushioning element together; and a second tubular portion forming step of forming the second tubular portion around the second cushioning portion of the first bag-shaped cushioning element and the second cushioning portion of the second bag-shaped cushioning element by bending the second tubular portion formation part so as to surround the second cushioning portion of the first bag-shaped cushioning element and the second cushioning portion of the second bag-shaped cushioning element together.

9. A packing body comprising:

an object;

an outer box that packs the object; and a plurality of cushioning members arranged between the object and the outer box, wherein each of the plurality of cushioning members is the cushioning member as recited in claim 1, and the plurality of cushioning members include:

a first cushioning member arranged between the object and the outer box in the parallel posture; and a second cushioning member arranged between the object and the outer box in the intersecting posture.

* * * * *